US006292082B1

(12) United States Patent
Vogel et al.

(10) Patent No.: US 6,292,082 B1
(45) Date of Patent: Sep. 18, 2001

(54) IGNITION DEVICE FOR AN INTERNAL COMBUSTION ENGINE

(75) Inventors: Manfred Vogel, Ditzingen; Dieter Betz, Vaihingen; Werner Herden, Gerlingen; Karl-Heinz Nuebel, Simmozheim; Bernd Fischer, Immenstadt; Christian Bonnefoit, Martinszell, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/429,421

(22) Filed: Oct. 28, 1999

(30) Foreign Application Priority Data

Nov. 3, 1998 (DE) ..... 198 50 519

(51) Int. Cl.[7] ..... H01F 27/04; H01F 27/02
(52) U.S. Cl. ..... 336/96; 336/107; 336/208
(58) Field of Search ..... 123/634, 635, 123/620; 336/198, 208, 192, 96, 107

(56) References Cited

U.S. PATENT DOCUMENTS 6,094,122 * 7/2000 Sexton ..... 336/96

FOREIGN PATENT DOCUMENTS 39 20 080 1/1991 (DE) .
0837481A2 * 4/1998 (EP) ..... 336/192

* cited by examiner

*Primary Examiner*—Anh Mai
(74) *Attorney, Agent, or Firm*—Kenyon & Kenyon

(57) ABSTRACT

An ignition device for an internal combustion engine occupies a small amount of space and is suited for efficient manufacturing. For this purpose, the ignition device has an ignition coil which is designed as a bar ignition coil having a coil former arranged concentrically to a longitudinal axis of the ignition coil, an insulation carrier being coaxially attached to the coil former. The coil former is provided with a winding set, the winding wire of which is continued to the insulation carrier. At this point, an interference suppression element in the form of an inductor is implemented in a continued winding. The ignition device is preferably utilized in motor vehicles.

9 Claims, 1 Drawing Sheet

IGNITION DEVICE FOR AN INTERNAL COMBUSTION ENGINE

FIELD OF THE INVENTION

The present invention relates to an ignition device for an internal combustion engine. The ignition device has at least one ignition coil which is provided for direct contacting with a spark plug of the internal combustion engine.

BACKGROUND INFORMATION

German Patent Application No. 39 20 080 describes an ignition device having several ignition coils for an internal combustion engine in which each of the ignition coils is arranged above a well of the cylinder head of the internal combustion engine. A high-voltage plug connector joined to each ignition coil is inserted in the well, the plug connector forming the connection between a high-voltage output of the ignition coil and a terminal stud of the spark plug which is fixedly inserted in the well.

The spark plug connector contains a cylindrical, elongated interference suppression resistor, whose longitudinal extent is flush with the longitudinal extent of the well.

A disadvantage of this arrangement of the ignition coil in conjunction with the joined spark plug connector and its elongated interference suppression resistor is that the ignition device is bulky in size and can no longer be used in tight installation circumstances.

SUMMARY OF THE INVENTION

An advantage of the ignition device according to the present invention is that the aforementioned inadequacy is avoided to a satisfactory degree. For this purpose, instead of the interference suppression resistor, an interference suppression element in the form of an inductor is used which dampens the electrical interference energy occurring at the spark plug during an ignition sequence by its alternate current resistance. The inductor is at least in part formed from a winding wire which is also used in the production of a winding set of an ignition coil.

This design makes it possible to integrate the interference suppression element into the ignition coil advantageously in terms of design and production engineering. In the ignition device, this results in a reduction of space requirements, connection points, installation expense, number of components and consequently costs as well.

DETAILED DESCRIPTION

Figure 1:
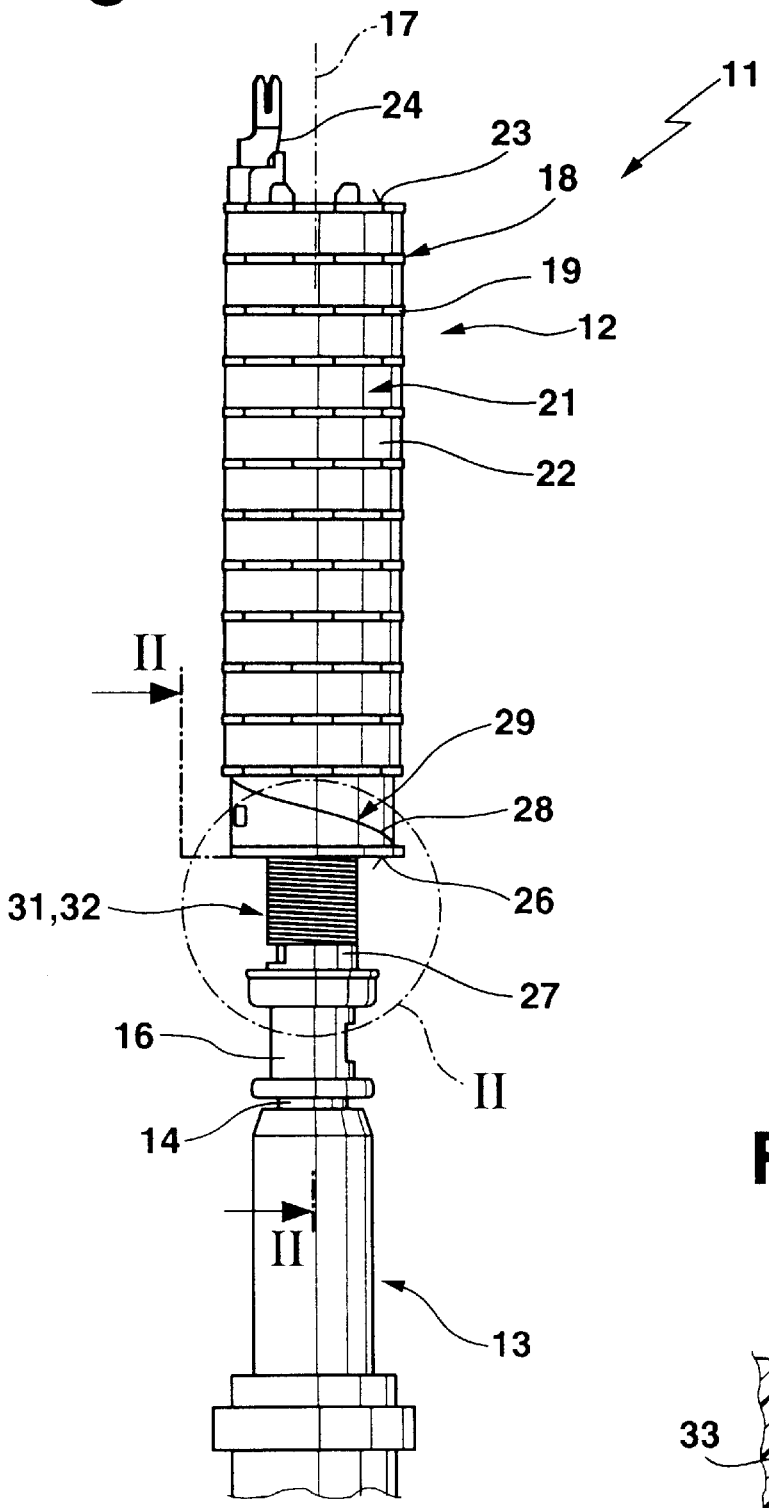
FIG. 1 shows a part of the ignition device in a side view.
Figure 2:
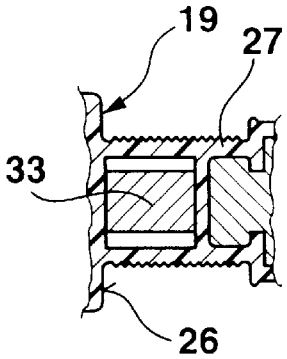
FIG. 2 shows a detail from FIG. 1 as a cross section along line 11—11 in FIG. 1.

An ignition device 11—shown partially in FIGS. 1 and 2—of an internal combustion engine, a multi-cylinder internal combustion engine in particular, has an ignition coil 12 for each cylinder. Ignition device 11 is intended to be mounted on a cylinder head of the internal combustion engine in a known manner which is not described in greater detail. A so-called spark plug well is formed in the cylinder head for each cylinder. A spark plug 13 is fixedly inserted in each of these wells and recessed, the spark plug having terminal stud 14 for contacting a contact piece 16 of the assigned ignition coil 12 at one inlet port of the well.

Each of ignition coils 12 is formed as a bar ignition coil and is intended for insertion into the assigned well. As a largely rotationally symmetrical part, ignition coil 12 contains an elongated cylindrical core made of magnetizable material arranged coaxially to a longitudinal axis 17 in a manner not shown, the core being surrounded, in an electrically insulating manner, by a primary winding carrying a low voltage.

A winding set 21 in the form of a secondary winding 22 carrying high voltage when ignition coil 12 is operated is arranged at a radial spacing to the primary winding on a coil former 18 of ignition coil 12, the coil former being in the form of a secondary coil former 19 subdivided into chambers.

One end of secondary winding 22 is electrically connected to an insulation piercing connecting device 24 extending axially outwards at one end face 23 of secondary coil former 19. At the other end face 26 of secondary coil former 19, a cylindrical insulation carrier 27 is also attached in a rotationally symmetrical manner to longitudinal axis 17, it also being possible for the insulation carrier to be made of one piece with secondary coil former 19.

An end section 28 of a winding wire 29, from which secondary winding 22 is wound, is guided uninterruptedly to insulation carrier 27 and in a continued winding at this point forms an inductor 31 as interference suppression element 32. After that, the end of winding wire 29 is connected to contact piece 16 of ignition coil 12 so as to be electrically conductive, contact piece 16 being joined coaxially to insulation carrier 27 in a manner which is not shown in greater detail. Ignition coil 12 is in electrical contact with terminal stud 14 of spark plug 13 via contact piece 16.

Inductor 31 is formed as an air-core inductor. However, it can, as shown in FIG. 2, also be formed as a coil with an internal ferrite core 33 or a core of a different ferromagnetic material.

The frequency response of the dampening can be adapted to the requirements for the electrical interference energy occurring in an ignition sequence in internal combustion engine 13 by the design of inductor 31 via the winding capacity.

If an especially high induction value of interference suppression element 32 is required within a small installation space, ferrite core 33 is inserted into insulation carrier 27, or if the latter is integrated in secondary coil former 19, the ferrite core is integrated in it.

The use of inductor 31 as interference suppression element 32 makes it possible to eliminate an interference suppression resistor having a resistance wire. Instead, inductor 31 can be formed from winding wire 29 in a common winding operation with the production of secondary winding 22.

Winding wire 29 is a copper wire which conducts electricity well. Consequently, interference suppression element 32 has only a slight ohmic component which, however, can be supplemented by other elements if necessary, for example, a spark plug resistor integrated in spark plug 13.

This design of interference suppression element 32 makes it possible for ignition device 11 to occupy little space when installed and to be manufactured efficiently.

What is claimed is:

1. An ignition device for an internal combustion engine, comprising:

at least one ignition coil directly contacting a spark plug of the engine, the at least one ignition coil including at least one winding set formed from a winding wire;

an interference-suppression element including an inductor having an alternating current resistance, wherein the alternating current resistance of the inductor dampens an electrical interference energy occurring at the spark plug during an ignition sequence, the inductor being formed, at least partially, from the winding wire, the inductor including a coil having a core composed, of a ferromagnetic material.

2. The ignition device according to claim 1, wherein the inductor is configured in one piece with the winding set of the at least one ignition coil as a continuation of a secondary winding.

3. The ignition device according to claim 1, wherein the inductor is an air-core inductor.

4. The ignition device according to claim 1, wherein the inductor includes a coil having a ferrite core.

5. The ignition device according to claim 1, wherein the inductor is integrated with a secondary coil former of the at least one ignition coil.

6. The ignition device according to claim 1, wherein one end of the inductor is at least indirectly connected to the spark plug for contacting so as to be electrically conducting with a contact piece of the at least one ignition coil.

7. The ignition device according to claim 1, wherein the inductor is integrated with a coil former of the at least one ignition coil.

8. The ignition device according to claim 7, further comprising an insulation carrier attached to the inductor.

9. The ignition device according to claim 8, wherein the insulation carrier is composed of one piece with the coil former and is rotationally symmetrical to the coil former.

* * * * *